United States Patent [19]

Rossem

[11] 4,286,169

[45] Aug. 25, 1981

[54] SCREENING DEVICE FOR A GENERATOR PRODUCING RADIO-ISOTOPES

[75] Inventor: Hendrik V. Rossem, Sint Maartensbrug, Netherlands

[73] Assignee: Byk-Mallinckrodt CIL B.V., Netherlands

[21] Appl. No.: 86,795

[22] Filed: Oct. 22, 1979

[30] Foreign Application Priority Data

Oct. 20, 1978 [NL] Netherlands ..... 7810503

[51] Int. Cl.[3] ..... G21C 11/00; G21F 1/00

[52] U.S. Cl. ..... 250/515

[58] Field of Search ..... 250/498, 506, 507, 515, 250/432 PD

[56] References Cited

U.S. PATENT DOCUMENTS 3,474,250 10/1969 Jelatis et al. ..... 250/515

FOREIGN PATENT DOCUMENTS 995185 6/1965 United Kingdom .

1220027 1/1971 United Kingdom .

1279076 6/1972 United Kingdom .

*Primary Examiner*—Bruce C. Anderson

*Attorney, Agent, or Firm*—Bernard & Brown

[57] ABSTRACT

A shield or screening device for radio-isotope producing generator including a moveable portion which can be moved relative to a stationary portion between a closed position to cover the generator and an open position to allow the generator to be inserted or withdrawn from the shielding device. The interaction of these two portions minimizes space required to use and shield the generator. Each portion is configured to effect relative rotative movement so that the moveable portion can be rotated concentrically within the circumference of the stationary portion. The generator can be inserted through the openings defined by the adjacent moveable and stationary portions in the open position. Once the generator is in place, the moveable portion is simply rotated to the closed position where the generator is substantially completely enclosed by the stationary and moveable portions of the shield.

6 Claims, 2 Drawing Figures

SCREENING DEVICE FOR A GENERATOR PRODUCING RADIO-ISOTOPES

BACKGROUND AND DISCUSSION OF THE INVENTION

The invention generally relates to a screening or shielding apparatus for a generator producing radio-isotopes, particularly radio-isotope solution that can be used as a diagnostic agent adapted for intravenous administration. The generator typically used for this situation produces daughter radioactive isotopes from elution of parent isotopes within the generator. The generator, often referred to as a "cow", is constructed so that the user can at any desired instance draw at a tapping point on the generator a quantity of solution containing the radio-isotopes. A radio-isotope suitable for this purpose is Technetium 99 m (hereinafter referred to as 99 mTc) which is obtained from the parent isotope Molybdenum-99 (hereinafter 99 Mo) in a 99 mTc generator. Typically these generators are designed and configured to produce a sterile 99 mTc solution as a diagnostic. With the parent isotope present in the generator producing a high radiation intensity, extensive safety measures should be taken to shield the operator. For this purpose a lead screening jacket, or jacket of any other material preventing penetration of radioactive material, is employed to provide sufficient protection for storage and transport.

Typically such a generator is maintained for relatively long periods of time in that vicinity of a hospital or clinical laboratory where it finds its greatest use. Although the generator itself is surrounded by a screening jacket or shield, it has been found desirable to provide additional protection against radioactive radiation for the hospital or laboratory staff who are regularly in the direct proximity of the generator. For this purpose the generator is additionally surrounded by extra lead shielding device. Where the extra shielding material is employed, a tapping point for the eluent solution containing the radio-isotope diagnostic must be provided at a position readily accessible to the operators. If the eluent is outside the generator, the shield must also have an easily accessible connection point for the holder of eluent. These additional access means must include closure for the opening or openings of a material and configuration which will satisfactorily shield the users from the radiation produced. Such a closure is typically a lead stopper.

When the yield of radio-isotope obtained by elution becomes insufficient the generators must be replaced by a fresh one, in the case of a 99 mTc generator usually every one to two weeks. As a result, the shield must be constructed so that the generator can be readily replaced by a fresh one when the desired yield has been depleted. Shielding devices employed heretofore have included concentric lead rings which are covered on top by a lead coverplate. When the need to replace the generator arises, the lead cover and the lead rings are removed one by one to allow withdrawal of the old generator and replacement by a fresh generator. Once the fresh generator is in place the rings must be replaced again successively around the new generator. This laborious process unnecessarily exposes the operator to radioactive radiation for a relatively lengthy period of time.

Another shielding device has included a lead vessel having a lead cover which, after removal of the cover, allows the old generator to be lifted from the vessel and a fresh generator replaced. The problem with this approach is that it is rather awkward for the operator to accommodate this type of procedure. For example these lead vessels are typically maintained in a hospital or laboratory in a hooded enclosure area. Hence the space above the lead vessel is restricted severely impeding replacement of the generator. This is a problem which becomes even more acute when one appreciates that the generator is itself formed of lead shielding material and is of considerable weight. As a result when being lifted above the lead vessel in a restricted hood, the generator could easily slip from the operator's hands and cause serious radioactive accidents. Because the generator producing the radio-isotopes comprises a large quantity of radioactivity, should the generator be damaged and the radioactive material released, serious danger could result to the health and safety of those in the vicinity of such an accident.

Although some shielding devices avoid some of the problems discussed, they still have not proved to be completely satisfactory. Such devices include a 99 mTc generator commercially available under the tradename Stercow 99 M. This shield includes a lead base plate and a lead jacket extending vertically therefrom. The enclosure has a closeable opening to the tapping point for the solution containing the 99 mTc. The cylindrical lead jacket is divided into two substantially equal halves which can be moved relative to one another, as well as the base plate, in the lateral direction. The moving parts of the lead jacket are slideable on rails or slides provided on the base plate and have grips on either side of moveable parts to provide manual means for moving towards and away from one another. By moving the parts of the jacket apart, an opening is obtained sufficiently large to allow removal of the depleted generator and replacement by a fresh generator. Once the fresh generator is in place, the lead jacket halves are simply moved toward each other and substantially completely shield the generator.

Although this device may remove some of the disadvantages discussed above, there still remains the need for sufficient space in the lateral direction for this device to be operable. As generators are often placed in relatively small enclosed spaces there is typically little or no additional room to accommodate such lateral movements. In some countries administrative bodies, such as The Netherlands Ministry of Health, require a safe place which may include a hood or sterile cupboard. The loss of space which typically accompanies such a requirement is considerable and may preclude the use of a device such as the Stercow 99 M where the outside diameter of the jacket in the closed position is less than 30 centimeters, but in the moved apart condition the device occupies a width of 95 centimeters.

The invention described herein provides a shield for a generator producing radio-isotope solutions which overcomes the disadvantages of those shielding devices discussed above in connection with the prior art, including that of the Stercow 99 M. The screening device of the invention described herein includes a lead jacket extending vertically from a lead bottom portion. Access is provided in the shield to a tapping point for the solution containing radio-isotope. In addition, a closeable opening is provided in the lead jacket characterized by two parts of which one is stationary with respect to the bottom portion and the other is rotatable with respect to the bottom portion. The stationary portion of the jacket has an opening which is sufficiently large to provide passage therethrough of the generator. The rotatable or moveable portion also has an opening which is sufficiently large to provide passage therethrough of the generator and is rotatable between an open position where the openings register to permit passage of a generator and a closed position where the generator is completely covered. The rotatable portion is concentric with the stationary portion such that when in the open position the rotatable portion is substantially adjacent to the stationary portion and provides easy access to the generator.

With this invention the replacing of a depleted generator is substantially easier than those known heretofore. A generator can be placed within the screening device according to this invention by simply turning away the rotatable part of the jacket while maximizing effective use of space. In other words, unlike some of the devices described above, the shield apparatus of the subject invention can be moved between the open position for placing the generator within the device without requiring more space than the closed position. Specifically, as will be described in the preferred embodiment hereinafter, the screening device according to this invention would not occupy any more than 35 centimeters in either the open or closed position. Consequently, a considerable gain in space is obtained through the uses of the subject invention over those shielding devices of the prior art described above.

Of course the invention need not be cylindrical in configuration but rather can have a number of configurations so long as the general principle of concentricity and reduction in operating space is achieved. In some generators the eluent is contained in a separate holder outside of the generator. In this case the internal configuration of the shielding device is changed accordingly to accommodate this separate holder, and as a result, there is usually an extra closeable opening through which access is gained to the eluent holder from a position outside of the device. Such differences in operation and configuration of the generator can readily be accommodated by the subject invention.

The inventive screening device need not be restricted to use with a generator producing radio-isotopes; but rather may serve to store other radioactive products or materials. The invention will be described in greater detail with reference to the preferred embodiment shown in the accompanying drawings.

DETAILED DESCRIPTION OF THE PREFERRED EMBODIMENT

Figure 1:
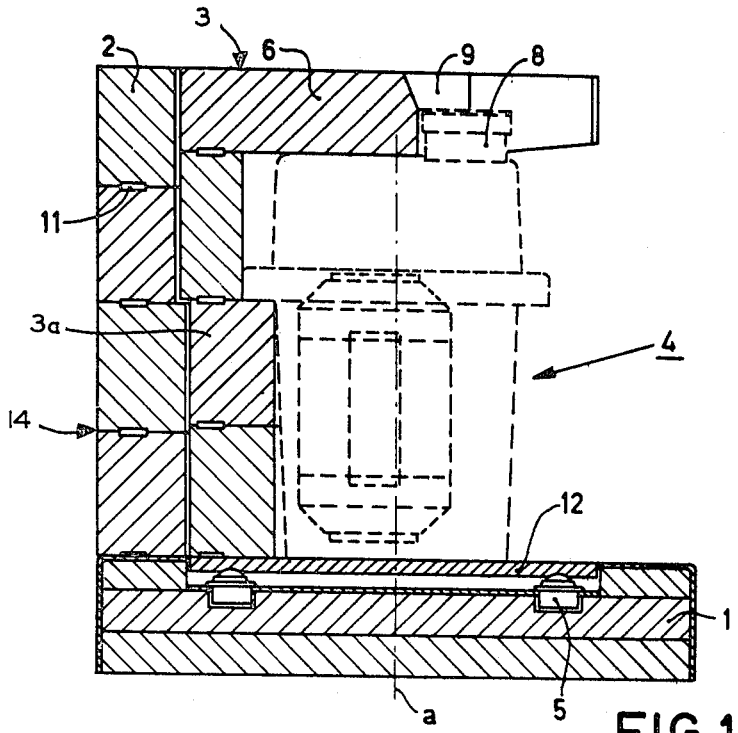
FIG. 1 is a longitudinal sectional view of the shielding device according to the invention in side elevation.
Figure 2:
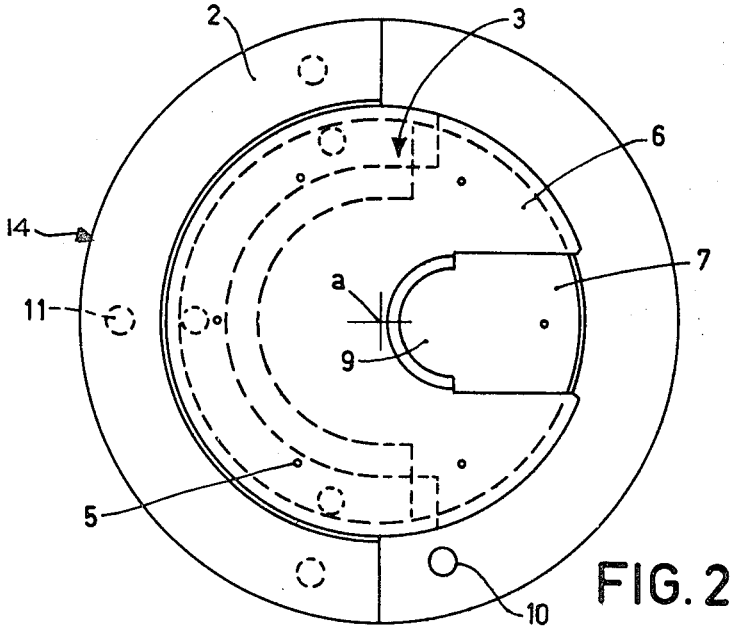
FIG. 2 is a plan view of the device as shown in section in FIG. 1.

From FIG. 1 it can be seen that the shielding device includes a stationary portion 14 and a rotatable portion 3 moveable between a closed and open position. The stationary portion 14 includes a stationary jacket or wall part 2 which is fixed to and extends upwardly in a vertical direction from base plate or bottom portion 1. The stationary wall part 2 is cylindrical in configuration and, as can be seen in FIG. 2, extends through an arc of approximately a semicircle. Moveable portion 3 includes a rotatable wall part 3*a* fixedly secured to and extending upwardly from a rotatable plate 12. Rotatable wall part 3*a* is also cylindrical in configuration but has an external radius less than the internal radius of wall part 2. As shown, both the stationary portion 14 and the moveable portion 3 have an axis defined by axis a which renders two portions concentric with one another. Rotatable wall part 3*a* rotates about axis a between an open position, as shown in FIG. 1 and FIG. 2, and a closed position which is substantially opposite to that of the open position. The arcuate extension of the rotatable wall part 3*a* is greater than a semicircle and extends beyond the edges of the stationary wall part 2 in the closed position, as well as the open position, as can be seen in FIG. 2. In this way when the moveable portion 3 is moved to the closed position there will be overlap of the moveable wall part 3*a* with the stationary wall part 2 such that no gaps will appear where radiation leakage might otherwise occur.

Both the moveable portion 3 and the stationary portion 14 of the shielding apparatus are formed by several lead parts constructed of segments stacked one upon the other in the vertical direction and secured to one another by means of studs 11 in a well known manner. From FIG. 1 it can be seen that in addition to the base plate 1 the stationary portion includes four lead arcuate members stacked one upon the other with each one being secured to the other by studs 11. Similarly, moveable portion 3 includes four lead members stacked one upon the other with the lowermost member secured to rotatable plate 12.

The topmost segment 6 is substantially circular in configuration and forms a cover for the generator when it is placed within the shielding apparatus. Cover 6 includes a recessed or slotted portion 7 for receiving a boss 8 of the generator 4. This boss contains the access means to the solution containing the radioactive isotope within the generator. A lead closure member (not shown) is provided to cover completely or at least a portion of slotted portion 7. In this preferred embodiment the closure member has a configuration to accommodate the boss 8 and also leave an opening 9 to facilitate access to boss 8 for obtaining the radio-isotope solution from the generator. To close the opening 9 a separate lead stopper is used.

The slotted portion 7 in cover 6 permits removal of the generator from the shielding apparatus once the radioactive material has been depleted. The slotted area has a width slightly greater than the effective diameter of boss 8 and extends from approximately the center of the cover to the periphery thereof such that when the rotatable part is moved to the open position and the closure member removed, as shown in FIG. 2, there will be no impediment to removal of the generator from the device. On the other hand, when in the closed position the slot will be facing the stationary portion thereby preventing any movement of the generator out of the device.

Base portion 1 is provided with a circular recessed area to rotatably receive base plate 12. A suitable bearing mechanism is supported within this recessed area to engage the under surface of base plate 12. As shown in FIG. 1, the bearing mechanism includes a number of ball and socket elements 5 equally spaced about the periphery of base plate 12 with the balls engaging the under surface thereof. The interaction of the ball and socket elements 5 with base plate 12 allow the moveable portion to rotate more easily about axis a than if some bearing mechanism were not employed.

By having both the stationary portion and the moveable portion arranged in this manner, once the assembly has been made through the stacking of the segments and the securing to one another by studs 11, the assembly operation is a non-recurring one, because replacement of the generator can be accomplished without any assembly or disassembly operation. The need to avoid such assembly and disassembly operations becomes apparent when one considers that the weight of such a device is between 100 and 200 kilograms. These segments are secured together in a usual manner by projections or studs 11 engaging in complementary holes in adjacent parts.

The shielding apparatus of this invention includes a mechanism for locking the moveable portion of the device in the closed position. For this purpose a fixing means is employed such as a spring acting pawl secured to the stationary portion of the apparatus for engaging a recess in the moveable portion of the apparatus when turned to the closed position. The pawl is released by actuation of a knob 10 which extends beyond the exterior of the device for actuation by the operator. In this manner the pawl can simply be released from the recess by moving knob 10 to a position corresponding to an open position. This in turn disengages rotatable plate 12, after which the rotatable part of the jacket can be moved. In the preferred embodiment the spring actuated pawl will automatically engage the recess when the rotatable plate reaches the closed position. Otherwise, the exposed knob remains in a position corresponding to the open position of the apparatus. Thus, the position of the visible knob acts as an indicator for whether the rotatable part is properly closed or not.

Preferably the parts of the jacket are substantially cylindrical in configuration and concentric with one another so that the moveable part can rotate in a relatively small space. By having the consumption of material and space maintained at a minimum, replacement of the generator can be facilitated readily without endangering the operators or other personnel in the vicinity where such generators are normally kept. In addition, the dimensions of the two parts of the generator are matched to each other so that in the closed condition no radiation can leak away from the screening device. This results from a slight overlap of the parts when in the closed position, as described above, to prevent leakage which otherwise might occur. The inside diameter of the stationary part is only slightly greater than that of the rotatable part, and the clearance is maintained at a minimum to achieve a reduction in space. Similarly, it is advantageous for the inside diameter of the rotatable part to be only slightly larger than the outside diameter of the generator. As a result, the space is used optimally and the consumption of material is minimized.

In operation, when it is desired to replace the generator the knob 10 is moved outwardly to disengage the pawl from the recess in plate 12. The moveable portion is simply rotated to the fully open position where, as can be seen in FIG. 2, the rotatable wall part is adjacent to the stationary wall part along its entire perimeter. The closure member is then removed so there is no impediment for the boss 8. In this position generator 4 slid outwardly through the opening provided for the removal of the rotatable part. A new generator is placed on base plate 12 with the boss 8 in the appropriate position relative to the slotted portion 7. The closure member is then placed on cover 6 at slotted portion 7. The moveable portion 3 is rotated to the closed position where the knob 10 automatically returns to its correct position, once the pawl has engaged its recess again, to fix the rotatable portion in the closed position. When needed the radioisotope solution can be withdrawn by removing the stopper from the opening 9, withdrawing the necessary solution and replacing the lead stopper to again protect the personnel in the area from radiation.

With this configuration as described above the features and other advantages of the invention are achieved.

I claim:

1. A shielding apparatus for a radioisotope producing generator where radioisotope containing solution is produced, comprising:

(a) a stationary portion comprising a first base and a first wall extending from said first base, said first wall being of substantially semi-cylindrical cross section to provide a first opening;

(b) a moveable portion, moveable between a closed position and an open position, said moveable portion comprising a second base moveably mounted on said first base, a top and a second wall extending between the second base and said top; said second wall being concentric with said first wall and being of substantially semi-cylindrical cross section to provide a second opening; one of said walls extending through more than 180° so that said walls overlap in the closed position of said moveable portion to insure effective shielding; said moveable portion in its open position having said second opening aligned with said first opening to provide a passage of sufficient size for movement of the generator therethrough;

(c) said moveable portion and said stationary portion being comprised of material preventing penetration of radiation from the generator;

(d) said stationary portion and said moveable portion each including segments placed vertically one on top of the other.

2. The apparatus according to claim 1 wherein said second wall has an outer diameter slightly less than the inside diameter of said first wall to allow rotation of said moveable portion inside of said stationary portion and said second wall has an arc greater than that of said first wall to provide overlap of said second wall with said first wall in the closed position.

3. The apparatus according to claim 1 wherein the inside diameter of said second wall is slightly greater than the outside diameter of said generator.

4. The apparatus according to claim 3 comprising means for fixing said moveable portion in the closed position.

5. The apparatus according to claim 4 wherein said fixing means comprises spring means engageable with a complementary portion connected to said second wall to provide a detent which must be overcome for the moveable portion to be moved to the fully open position.

6. The apparatus according to claim 5 wherein said generator includes a boss extending upwardly therefrom to provide access to the radioactive isotope containing solution, said top including a slotted portion for receiving said boss, a closure member for covering said slotted portion while said generator is contained within said device, said closure member defining with said slotted portion another opening located above said boss to provide access to said boss, and a stopper for covering said other opening when not being used for gaining access to said boss.

* * * * *